US008079197B2

(12) United States Patent
Suarez, Sr. et al.

(10) Patent No.: US 8,079,197 B2
(45) Date of Patent: Dec. 20, 2011

(54) INTERLOCKING MESH

(76) Inventors: Felix E. Suarez, Sr., Hialeah, FL (US); Felix E. Suarez, Jr., Miami, FL (US); Manuel J. Suarez, Miami, FL (US)

( * ) Notice: Subject to any disclaimer, the term of this patent is extended or adjusted under 35 U.S.C. 154(b) by 579 days.

(21) Appl. No.: 11/941,744

(22) Filed: Nov. 16, 2007

(65) Prior Publication Data

US 2008/0172974 A1 Jul. 24, 2008

Related U.S. Application Data

(60) Provisional application No. 60/881,320, filed on Jan. 19, 2007.

(51) Int. Cl.
*E04C 5/06* (2006.01)
*E04C 5/18* (2006.01)

(52) U.S. Cl. ..... 52/662; 52/414; 52/649.1

(58) Field of Classification Search ..... 52/662, 52/414, 649.1, 649.2, 649.3, 649.4, 650.3, 52/648.1
See application file for complete search history.

(56) References Cited

U.S. PATENT DOCUMENTS 371,844 A * 10/1887 Jackson ..... 52/600
782,877 A * 2/1905 Roney ..... 52/649.2
1,010,408 A * 12/1911 Bates ..... 52/651.02
1,040,408 A * 10/1912 Bates ..... 208/32
1,403,520 A * 1/1922 Oliver ..... 52/454
1,410,633 A * 3/1922 White ..... 52/688
1,476,939 A * 12/1923 White ..... 52/686
2,665,578 A * 1/1954 Hillberg ..... 24/339
2,667,060 A * 1/1954 Campbell ..... 52/565
2,730,388 A * 1/1956 Roberton ..... 403/207
2,897,688 A * 8/1959 Graybill ..... 475/75
3,015,194 A * 1/1962 Clark ..... 52/396.03
3,110,982 A * 11/1963 Besinger ..... 52/649.2
3,245,190 A * 4/1966 Reiland ..... 52/649.3
3,324,611 A * 6/1967 Gamber ..... 52/91.1
3,407,560 A * 10/1968 Baumann ..... 52/645
3,559,355 A * 2/1971 Day, Jr. ..... 52/672
3,604,180 A * 9/1971 Wood ..... 52/649.3
3,672,022 A * 6/1972 York ..... 428/593
3,748,720 A * 7/1973 Versteeg ..... 228/173.5
3,838,837 A * 10/1974 Tolliver ..... 245/1
3,857,416 A * 12/1974 Borodin et al. ..... 138/175
4,031,685 A * 6/1977 Heinz ..... 52/649.4
4,037,751 A * 7/1977 Miller et al. ..... 428/593
4,132,045 A * 1/1979 Sullivan ..... 52/685
4,245,926 A * 1/1981 Asszonyi et al. ..... 405/150.1
4,318,520 A * 3/1982 Walker ..... 248/97
5,446,254 A * 8/1995 Ritter et al. ..... 219/56
5,527,590 A * 6/1996 Priluck ..... 428/198
5,540,023 A * 7/1996 Jaenson ..... 52/343

(Continued)

FOREIGN PATENT DOCUMENTS

EP 127582 A2 * 12/1984
WO WO 9316825 A1 * 9/1993

*Primary Examiner* — Brian Glessner
*Assistant Examiner* — Joseph J Sadlon
(74) *Attorney, Agent, or Firm* — Fish & Associates, PC

(57) ABSTRACT

A wire mesh is formed by a plurality of identical wires. The wires interlock with each other by mutually receiving loops formed in the wires. Reinforcing wires welded to the loops reinforce the points of contact, and prevent the wires from rotating when locked together.

10 Claims, 1 Drawing Sheet

U.S. PATENT DOCUMENTS 5,800,095 A 9/1998 Egan
6,003,281 A * 12/1999 Pilakoutas ..... 52/742.14
6,186,703 B1 2/2001 Shaw
6,691,486 B1 * 2/2004 Durand ..... 52/645
7,422,187 B2 * 9/2008 Traut ..... 248/431
2006/0059804 A1 3/2006 Brown

* cited by examiner

FIG. 1
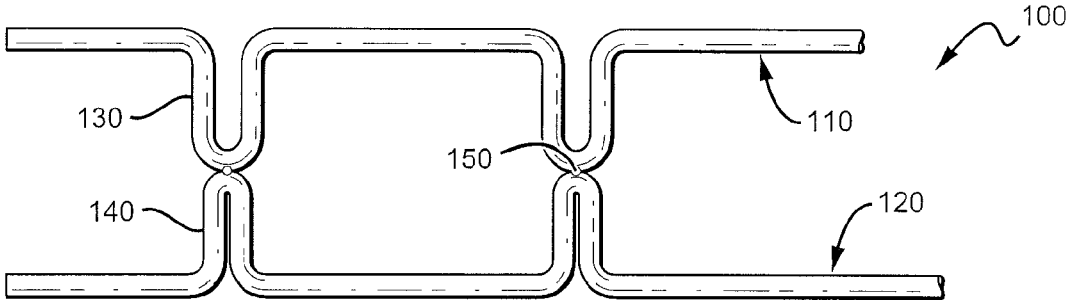
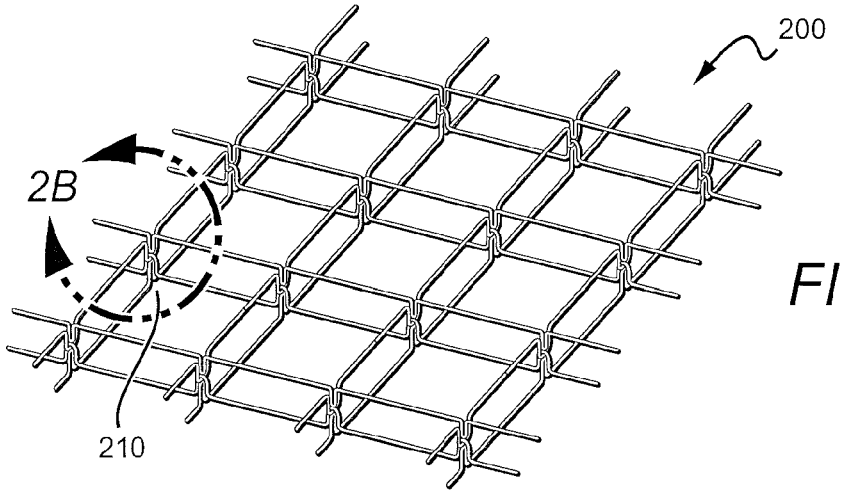
FIG. 2A
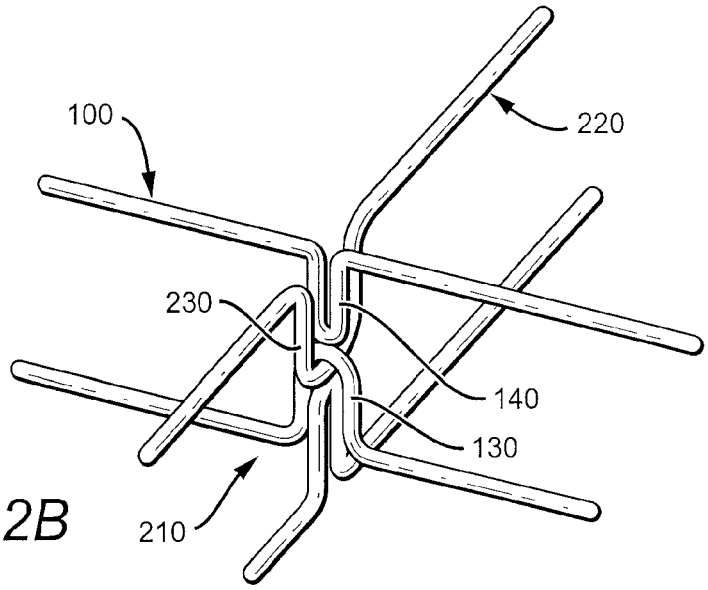
FIG. 2B

INTERLOCKING MESH

This application claims priority to our copending U.S. provisional patent application with the Ser. No. 60/881320, filed Jan. 19, 2007, and which is incorporated by reference herein.

FIELD OF THE INVENTION

The field of the invention is construction support devices.

BACKGROUND

It is known in the art to provide frames or skeletons to help reinforce and strengthen material that would otherwise be brittle. For example, rebar is commonly used in roads to provide added strength. For inexpensive jobs that require less strength, wire mesh is frequently sufficient.

Wire mesh, however, must be sized properly for different jobs and different needs. Additionally, large and planar wire mesh pieces can be rather cumbersome to transport. Smaller "sheets" of wire mesh may be transported on-site for ease of conveyance, but these sheets must be later welded on-site.

Thus, there is still a need for wire mesh that is easy to transport and can be assembled onsite without the use of additional tools.

SUMMARY OF THE INVENTION

The present invention provides apparatus, systems and methods in which a first wire with a first loop and a second wire with a second loop are hooked together so that the first and second loops receive each other. In a preferred embodiment, the first wire and the second wire are identical.

A reinforcing wire can be attached to the first wire or second wire to reinforce the loop. The reinforcing wire can be attached by any suitable means, but is preferably attached by welding. While the reinforcing wire can be attached to the first wire in any location, it is preferred that the reinforcing wire have a tight loop that attaches to the first loop. It is more preferred that the reinforcing wire comprise a plurality of tight loops that attach to a plurality of first loops on the first wire.

A grid can be formed by the mesh by using a plurality of first wires with a plurality of first loops and a plurality of second wires with a plurality of second loops, where the plurality of first loops mutually receive the plurality of second loops. The first wires are preferably parallel to one another and have identical shapes, and more preferably the first and second wires have identical shapes.

Various objects, features, aspects and advantages of the inventive subject matter will become more apparent from the following detailed description of preferred embodiments, along with the accompanying drawings in which like numerals represent like components.

BRIEF DESCRIPTION OF THE DRAWINGS

FIG. 1 is a side perspective view of a wire

FIG. 2A is a front perspective view of a wire mesh using the wire of FIG. 1

FIG. 2B is an enlarged, fragmentary view of the wire mesh of FIG. 2A

DETAILED DESCRIPTION OF THE DRAWINGS

In FIG. 1, a wire 100 generally comprises a first wire 110 and a reinforcing wire 120.

First wire 110 has loop 130, which is shaped to receive a mating loop (not shown) on another wire. While loop 130 is shaped to mutually receive a loop identical to itself, various mating loops could be of any suitable shape to receive the other loop.

All suitable reinforcements are also contemplated. In FIG. 1, for example, loop 130 is welded to reinforcing wire 120 at weld point 150, and reinforcing wire 120 is shaped into a tight loop 140 at weld point 150, so as to provide additional reinforcement to loop 130. Reinforcing wire 120 also prevents first wire 110 from rotating about an axis when coupled with another wire.

In FIG. 2A, a wire mesh 200 comprises a plurality of identical wires, with an intersection point 210, shown more clearly in FIG. 2B.

Wire 220 has a loop 230 that intersects wire 100 at intersection point 210. Loop 230 mutually receives identical loop 130, locking both into place. Tight loop 140 prevents wire 220 from rotating after the wires have been locked into place. Multiple intersection points provide a durable wire mesh 200 without the use of additional tools to lock the wires in place about an X and Y axis.

The interlocking mesh can be used in any suitable construction application requiring a mixture of concrete or other mixing material with the intent of constructing a hard tridimensional surface, for example concrete slabs, prefabricated walls, bridge support beams, bridge slabs, roads, highway sound barrier walls, airport landing strips, maritime equipment, marine equipment, tunnels (submergible and over the ground), anti-aircraft protection shields, mining support, nuclear disposable (residue) cemeteries, caskets, and roof slabs.

Thus, specific embodiments and applications of a wire mesh have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A concrete mesh, comprising:

a first wire having a plurality of first wire loops;

a second wire parallel to the first wire and coupled to the plurality of first wire loops to reinforce the first wire;

a third wire having a plurality of third wire loops; and a fourth wire parallel to the third wire and coupled to the plurality of third wire loops to reinforce the fourth wire; and a physical arrangement in which one of the first wire loops mutually receives one of the third wire loops, and wherein the physical arrangement prevents a movement of the first and second wires with respect to one another along at least two approximately perpendicular axes.

2. The concrete mesh of claim 1, wherein the second wire is coupled to the first wire by welding.

3. The concrete mesh of claim 1, wherein the second wire comprises a reinforcement loop that is coupled to the one of the first wire loops.

4. The concrete mesh of claim 3, wherein the second wire is coupled to the one of the first wire loops by attaching an outer bend of the reinforcement loop to an outer bend of the one of the first wire loops.

5. The concrete mesh of claim 1, wherein the first wire and the third wire are fungible.

6. The concrete mesh of claim 1, wherein the first wire and the third wire are substantially identical to one another.

7. The concrete mesh of claim 1, wherein the plurality of first wire loops are substantially identical to the plurality of third wire loops.

8. The concrete mesh of claim 1, wherein the one of the first wire loops is substantially identical with the one of the third wire loops.

9. The concrete mesh of claim 3, wherein the reinforcement loop is shaped into a tighter loop than the one of the first wire loops.

10. The concrete mesh of claim 1, further comprising:

a fifth wire having a plurality of fifth wire loops; and a sixth wire having a plurality of sixth wire loops, wherein the intersecting arrangement further comprises a first of the plurality of fifth wire loops mutually receiving a second of the plurality of first wire loops, a second of the plurality of fifth wire loops mutually receiving a first of the plurality of sixth wire loops, and a second of the plurality of sixth wire loops mutually receiving a second of the plurality of second wire loops to form a grid of wires.

* * * * *